US007070433B2

(12) United States Patent
Joegel et al.

(10) Patent No.: US 7,070,433 B2
(45) Date of Patent: Jul. 4, 2006

(54) PLUG COUPLING SYSTEM FOR DISENGAGEABLE ELECTRICAL CONNECTING OF A PROGRAMMABLE FIELD DEVICE WITH A FIELD BUS OR WITH A PROGAMMING DEVICE

(75) Inventors: Thomas Joegel, Immenstadt (DE); Thomas Haerle, Marktoberdorf (DE)

(73) Assignee: Endress & Hauser Wetzer GmbH & Co. KG, Nesselwang (DE)

( * ) Notice: Subject to any disclaimer, the term of this patent is extended or adjusted under 35 U.S.C. 154(b) by 13 days.

(21) Appl. No.: 10/866,084

(22) Filed: Jun. 14, 2004

(65) Prior Publication Data

US 2005/0070176 A1 Mar. 31, 2005

Related U.S. Application Data

(60) Provisional application No. 60/479,503, filed on Jun. 19, 2003.

(30) Foreign Application Priority Data

Jun. 27, 2003 (DE) ..... 103 27 013

(51) Int. Cl.
*H01R 27/00* (2006.01)

(52) U.S. Cl. ..... 439/218; 439/924.1

(58) Field of Classification Search ..... 439/218, 439/222, 924.1

See application file for complete search history.

(56) References Cited

U.S. PATENT DOCUMENTS 4,034,172 A * 7/1977 Glover et al. ..... 200/51.1
5,346,406 A * 9/1994 Hoffman et al. ..... 439/474

(Continued)

FOREIGN PATENT DOCUMENTS

DE 409687 2/1925

(Continued)

OTHER PUBLICATIONS

DE 101 486 631, published Apr. 10, 2003, Abstract.

(Continued)

*Primary Examiner*—Thanh-Tam Le
(74) *Attorney, Agent, or Firm*—Bacon & Thomas

(57) ABSTRACT

A plug coupling system includes a first coupling member connected with a transmitter-side end of the bus connection cable and having at least two contact elements, which are galvanically connected each with a respective conductor wire of a bus connection cable, a second coupling member connected with a transmitter-side end of a device connection cable and having at least two contact elements, which are galvanically connected each with a respective conductor wire of the device connection cable, and arranged on the transmitter side, a third coupling member having at least three contact elements, which are connected with a transmitter. The third coupling member is suited for selective, mechanically disengageable connection with one or the other coupling member such that each of the, in each case, at least two contact elements of the connected coupling member always contacts one of the at least three contact elements of the third coupling member, and that the at least two conductor wires of the connection cable connected at the moment are each electrically connected with a respective contact element of the transmitter-side coupling member. The contact elements are so designed and so arranged in their associated coupling members, that the contact element of the transmitter-side coupling member is not galvanically connectable with any of the conductor wires of the bus connection cable, but is galvanically connectable with at least one of the conductor wires of the device connection cable.

12 Claims, 2 Drawing Sheets

U.S. PATENT DOCUMENTS

| | | | | |
|---|---|---|---|---|
| 5,566,680 | A * | 10/1996 | Urion et al. | 600/561 |
| 6,113,429 | A * | 9/2000 | Weigel et al. | 439/610 |
| 6,352,447 | B1 * | 3/2002 | Ruth | 439/540.1 |
| 6,422,884 | B1 * | 7/2002 | Babasick et al. | 439/222 |

FOREIGN PATENT DOCUMENTS

| | | |
|---|---|---|
| DE | G 91 08 753.8 | 7/1991 |
| DE | 297 02 766 U1 | 5/1997 |
| DE | 100 17 319 A1 | 10/2001 |
| EP | 1 108 984 A1 | 6/2001 |

OTHER PUBLICATIONS

DE 196 17201, published Nov. 6, 1997, Abstract.
DE 199 15637, published Oct. 12, 2000, Abstract.
DE 100 55894, published May 29, 2002, Abstract.

* cited by examiner

PLUG COUPLING SYSTEM FOR DISENGAGEABLE ELECTRICAL CONNECTING OF A PROGRAMMABLE FIELD DEVICE WITH A FIELD BUS OR WITH A PROGAMMING DEVICE

This application claims the benefit of Provisional Application No. 60/479,503, filed Jun. 19, 2003.

FIELD OF THE INVENTION

The invention relates to a plug coupling system serving for the disengageable electrical connecting of a programmable field device with a field bus or with a programming device.

BACKGROUND OF THE INVENTION

In process automation technology, field measuring devices, especially two and four wire devices, are used for producing analog or digital measurement signals or measurement values representing parameters to be measured. Examples of the process parameters to be registered are mass flow rate, fill level, pressure, temperature, these being registered by means of a corresponding sensor, or a control variable, for instance an instantaneous valve position or an instantaneous rotation angle. See WO-A 98/44 317, WO-A 98/20 469, WO-A 98/14 850, WO-A 97/94 017, WO-A 97/07 444, WO-A 96/41 135, WO-A 96/05 484, EP-A 1 207 373, EP-A 1 108 984, EP-A 928 974, EP-A 780 665, U.S. Pat. No. 6,568,279, U.S. Pat. No. 6,330,517, U.S. Pat. No. 5,876,122, U.S. Pat. No. 5,829,876, U.S. Pat. No. 5,825,664, U.S. Pat. No. 5,812,428, U.S. Pat. No. 5,764,928, U.S. Pat. No. 5,764,891, U.S. Pat. No. 5,754,596, U.S. Pat. No. 5,573,032, U.S. Pat. No. 5,639,970, U.S. Pat. No. 5,495,769, U.S. Pat. No. 5,485,400, U.S. Pat. No. 5,481,200, U.S. Pat. No. 5,253,511, U.S. Pat. No. 4,926,340 for examples of such field devices having field device electronics for producing measurement signals representing process parameters.

Field measurement devices of the described type usually have a sensor for registering at least one process parameter and a transmitter connected, at least during operation, with the sensor for producing corresponding measured values for the registered process parameters. The measured values can then be sent, over a data transmission system connected electrically with the transmitter in an appropriate manner, to a superordinated process control system. By means of a process control computer provided in the process control system, the transmitted measured values are processed further and output in a suitable manner as measurement results, e.g. visualized on monitors, and/or converted into control signals for process actuators, such as magnetic valves, electro-motors, etc.

An elementary component of every data transmission system is an appropriate field bus, which is electrically connected with the involved field devices via appropriate bus connection cables. Suitable field bus systems are, by way of example, PROFIBUS-PA, FOUNDATION FIELDBUS, CAN-BUS or the like, in combination with appropriate interfaces, such as e.g. standard interfaces RS 232 or RS 485.

For the disengageable electrical connecting of field devices with the field bus, numerous plug coupling systems have established themselves, for example multipolar plug coupling systems with the coupling plugs of type M 12×1 or also ⅞" familiar to those skilled in the art. Plug coupling systems of the described type are disclosed, for example, in DE-A 100 20 191, DE-U 87 06 150, DE-U 87 06 148, DE-U 86 13 225 or DE-U 86 13 221 and include, most often, connected with a transmitter-side end of the bus connection cable, for example embodied as a plug part, a coupling member having two, or more, contact elements, each being lastingly, galvanically connected with a conductor wire of the bus connection cable. Additionally, such plug coupling systems include a transmitter-side, coupling member having at least two or more contact elements, which are lastingly connected with the transmitter.

The two coupling members are adapted for disengageable, mechanical connection with one another such that each of the contact elements of the one coupling member contacts its mating one of the contact elements of the other coupling member, in order that the conductor wires of the connected bus connection cable are each galvanically connected with one contact element of the transmitter-side coupling member. The contact elements of the transmitter-side coupling member, which, as disclosed also in U.S. Pat. 471 831 or U.S. Pat. 471 829, can be embodied as coupling sockets, are predominantly provided in the form of contact pins.

Accordingly, the contact elements of the coupling member connected with the bus connection cable are contact sockets, of which each is suited to receive one of the two contact pins of the transmitter-side coupling member.

Usually, such plug coupling systems additionally have appropriately designed means for preventing an accidental disengagement of the two connected coupling means, such as, for example, a screwed connection using a union nut; see, in this connection, DE-A 100 20 191 or DE-U 86 13 221. Additionally, such plug coupling systems are usually provided with means which assure prevention of a wrong connecting of the bus connection cable. For example, a groove extending axially in the plugging direction can be formed into one of the coupling members, with a corresponding ridge being formed on the other coupling member.

Besides the primary function, namely the production of measurement signals, modern field devices exhibit numerous other functionalities, which support an efficient and safe management of the process being observed. In this regard, to be counted among these other functions are the self-monitoring of the field device, the storage of measurements, the production of control signals for actuating elements, etc. Because of this high functionality of the field devices, process control functions can, to an increasing degree, be moved to the field level, and, as a result, process control systems are becoming correspondingly decentrally organized. Additionally, these extra functionalities include e.g. even the start-up of the field device and its connection to the data transmission system. These and, if need be, still more field device functions are, as, for example, in fact shown in the above-mentioned WO-A 98/44 317, WO-A 98/20 469, WO-A 98/14 850, WO-A 97/94 017, WO-A 97/07 444, WO-A 96/41 135, WO-A 96/05 484, EP-A 1 207 373, EP-A 1 108 984, EP-A 928 974, EP-A 780 665, U.S. Pat. No. 6,568,279, U.S. Pat. No. 6,330,517, U.S. Pat. No. 5,876,122, U.S. Pat. No. 5,829,876, U.S. Pat. No. 5,825,664, U.S. Pat. No. 5,812,428, U.S. Pat. No. 5,764,928, U.S. Pat. No. 5,764,891, U.S. Pat. No. 5,754,596, U.S. Pat. No. 5,573,032, U.S. Pat. No. 5,639,970, U.S. Pat. No. 5,495,769, U.S. Pat. No. 5,485,400, U.S. Pat. No. 5,481,200, U.S. Pat. No. 5,253,511, U.S. Pat. No. 4,926,340, realized by means of a field device electronics, including a microcomputer with accompanying data storage circuit and software implemented therein.

The software can be inserted before, or during, start-up of the field device into a permanent memory, e.g. a PROM, or a non-volatile, persistent memory, e.g. an EEPROM, of the microcomputer and, as required, loaded into a volatile memory, e.g. a RAM, for the operation of the field device. This permits reconfigurations of the functions implemented in the field device electronics to be accomplished for the most part by simple changes of the stored software. These changes can include e.g. changes of individual measuring device parameters and also the loading of complete evaluation programs. In the application of non-volatile memory elements for storing the software, one possibility for reconfiguring the field device electronics is, for example, to download the changed software from a mass storage, e.g. a diskette, a CD-ROM or a magnetic tape, and/or via a null-modem into a volatile memory of the signal processing unit, e.g. into RAM. Then, the software to be changed can, as described, for example, in EP-A 1 108 984, be replaced by the software located in the volatile memory.

Both the loading of the software and also its reconfigurations can, for example, be accomplished by means of a special programming device on site, connected by an appropriate device connection cable temporarily to the field device.

For the disengageable connecting of the programming device with the transmitter, besides the above-mentioned plug coupling system, either there is provided, inserted between transmitter and programming device, an additional plug coupling system, which includes a further, transmitter-side coupling member, which likewise can be brought together with a complementary coupling member electrically attached to a transmitter-side end of the device connection cable, or else, as usual especially in the case of two-wire devices, the device connection cable is clamped parallel to the bus connection cable, for example directly thereon.

Ever more frequently, field devices of the described type are embodied as two-wire devices, so that, both the power supply of the field device and the signal transmission to the field bus can occur over one and the same two-wire line. Beyond this, it is to be noted that even existing applications with, for example, four-wire devices, in which the energy supply of the field device and the signal transmission to the field bus occur over two, mutually-separated, two-wire lines, are increasingly to be replaced by two-wire devices.

Considering that the installation expense for field devices, especially that of the electrical cabling, can be quite significant (costs equalling the purchase price of field devices are, in no way, unusual here), it would be of advantage, if the already laid supply lines, in any case, however, the bus connection cable, could continue to be used and not have to be replaced by completely new lines.

In doing this, it has, however, been found that, when using the already laid, four, or more, core, bus connection cables for the new two-wire devices, disadvantages concerning electromagnetic compatibility or even voltage-separation can arise. Problems with the electromagnetic compatibility can e.g. arise, when the electrical connection between programming device and field device is to be made over the same transmitter-side coupling member as the electrical connection between field bus and field device. This can, especially, also be the case, when the transmitter of the field device, or the plug coupling system, as the case may be, are so constructed that the connecting of the programming device can only be accomplished after disconnecting the bus connecting line from the transmitter.

One possibility for improving the electromagnetic compatibility of such plug coupling systems is e.g. to build additionally directly into the plug coupling system and/or into the transmitter appropriate noise filters or voltage-separating circuits, but this would lead to an increased circuit expense and, consequently, to significantly increased costs.

SUMMARY OF THE INVENTION

An object of the invention is to improve conventional plug coupling systems for field devices such that, even when using one and the same transmitter-side coupling member for alternately connecting the field bus or the programming device, the same high quality with respect to electromagnetic compatibility and voltage-separation can be maintained in a very simple manner.

For achieving the object, the invention resides in a plug coupling system serving for the disengageable electrical connecting of a programmable field device with a field bus or with a programming device, wherein the field device has a sensor for registering at least one process parameter and at least one transmitter connected with the sensor at least during operation for producing measurement values from the registered process parameter, and wherein the transmitter is electrically connected with the field bus by means of a bus connection cable having a plurality of conductor wires at least for sending produced measurements onto the field bus and is electrically connected with the programming device by means of a device connection cable at least for receiving parametering data produced by the programming device, which plug coupling system includes:

a first coupling member connected with a transmitter-side end of the bus connection cable, which member has at least a first contact element, which is galvanically, especially lastingly, connected with a first conductor wire of the bus connection cable, and a second contact element, which is galvanically, especially lastingly, connected with a second conductor wire of the bus connection cable, a second coupling member connected with a transmitter-side end of the device connection cable, which member has at least a first contact element, which is galvanically, especially lastingly, connected with a first conductor wire of the device connection cable, and a second contact element, which is galvanically, especially lastingly, connected with a second conductor wire of the device connection cable, and arranged on the transmitter side, a third coupling member having at least a first, a second and a third contact element, which contact elements are connected, especially lastingly, with the transmitter, wherein the third coupling member is suited for selective, mechanically disengageable connection with the first coupling member or with the second coupling member such that each of the, in each case, at least two contact elements of the first coupling member or the second coupling member, as the case may be, always contacts a respective one of the at least three contact elements of the third coupling member, and the at least two conductor wires of the connection cable connected at the moment are each electrically connected with a respective one contact element of the third coupling member, and wherein the contact elements are so designed and so arranged in the associated coupling members, that the third contact element of the third coupling member is not galvanically connectable with any of the conductor wires of the bus connection cable, but is galvanically connectable with at least one of the conductor wires of the device connection cable.

In a preferred first embodiment of the invention, the first contact element and the second contact element of the third coupling member are provided in the form of contact pins and the first contact element and the second contact element of the first coupling member are provided in the form of contact sockets, with each of the two contact sockets of the first coupling member being suited to receive a respective one of the two contact pins of the third coupling member.

In a preferred second embodiment of the invention, at least the first contact element of the second coupling member is likewise provided in the form of a contact socket, which is suited for receiving one of the two contact pins of the third coupling member.

In a preferred third embodiment of the invention, the third contact element of the third coupling member has a length in the coupling direction, which is smaller than the respective lengths of its first and second contact elements.

In a preferred fourth embodiment of the invention, at least the second contact element of the second coupling member is likewise provided in the form of a contact pin, which is suited for contacting the third contact element of the third coupling member.

In a preferred fifth embodiment of the invention, at least the second contact element of the second coupling member is resiliently seated such that it is displaceable at least in the coupling direction when acted upon by the contacting, third contact element and, in the case of connected second and third coupling members, at least in an end position, is held pressed against the contacting, third contact element.

In a preferred sixth embodiment of the invention, the first coupling member has at least one third contact element, especially one formed identically to its second contact element.

In a preferred further development of the aforementioned embodiment of the invention, the bus connection cable has a third conductor wire galvanically connected with the contact element of the first coupling member, especially a third conductor wire which is decommissioned.

In a preferred seventh embodiment of the invention, the second coupling member has at least one third contact element, especially a third contact element which is constructed identically to its second contact element.

In a preferred further development of the aforementioned embodiment of the invention, the device connection cable has a third conductor wire galvanically connected galvanically with the contact element of the second coupling member.

In a preferred eighth embodiment of the invention, the third coupling member has at least one, fourth contact element, especially a fourth contact element constructed identically to its third contact element.

In a preferred ninth embodiment of the invention, the contact elements are so designed and so arranged in their associated coupling members, that also the fourth contact element of the third coupling member, while not being galvanically connectable with any of the conductor wires of the bus connection cable, is, however, galvanically connectable with at least one of the conductor wires of the device connection cable.

The invention is based on the realization that, often, the transmitters of the field devices are embodied such that the field device can be reprogrammed only after it has been switched "off-line", thus, at least, out of transmitting operation, preferably, however, also after it has been taken out of measuring operation. As a result of this, it is possible, for connecting the programming device, first to effect a separating of the transmitter from the field bus, in order to make free a plugging location for the programming device. A fundamental idea of the invention is, consequently, to structure the transmitter-side coupling member and the coupling member of the device connection cable such that they can be connected together, when the bus connection cable has been removed from the transmitter. Thus, the transmitter can either be connected electrically with the field bus by means of the bus connection cable, especially for transmitting produced measurements to the field bus, or with the programming device by means of the device connection cable, especially for receiving parametering data produced by the programming device.

The invention and additional advantages thereof will now be explained on the basis of examples of embodiments illustrated in the figures of the drawings. Equal elements are provided in all figures with the same reference characters; when it is useful for clarity, already mentioned reference symbols are dispensed-with in subsequent figures.

DESCRIPTION OF THE PREFERRE EMBODIMENTS

Figure 1:
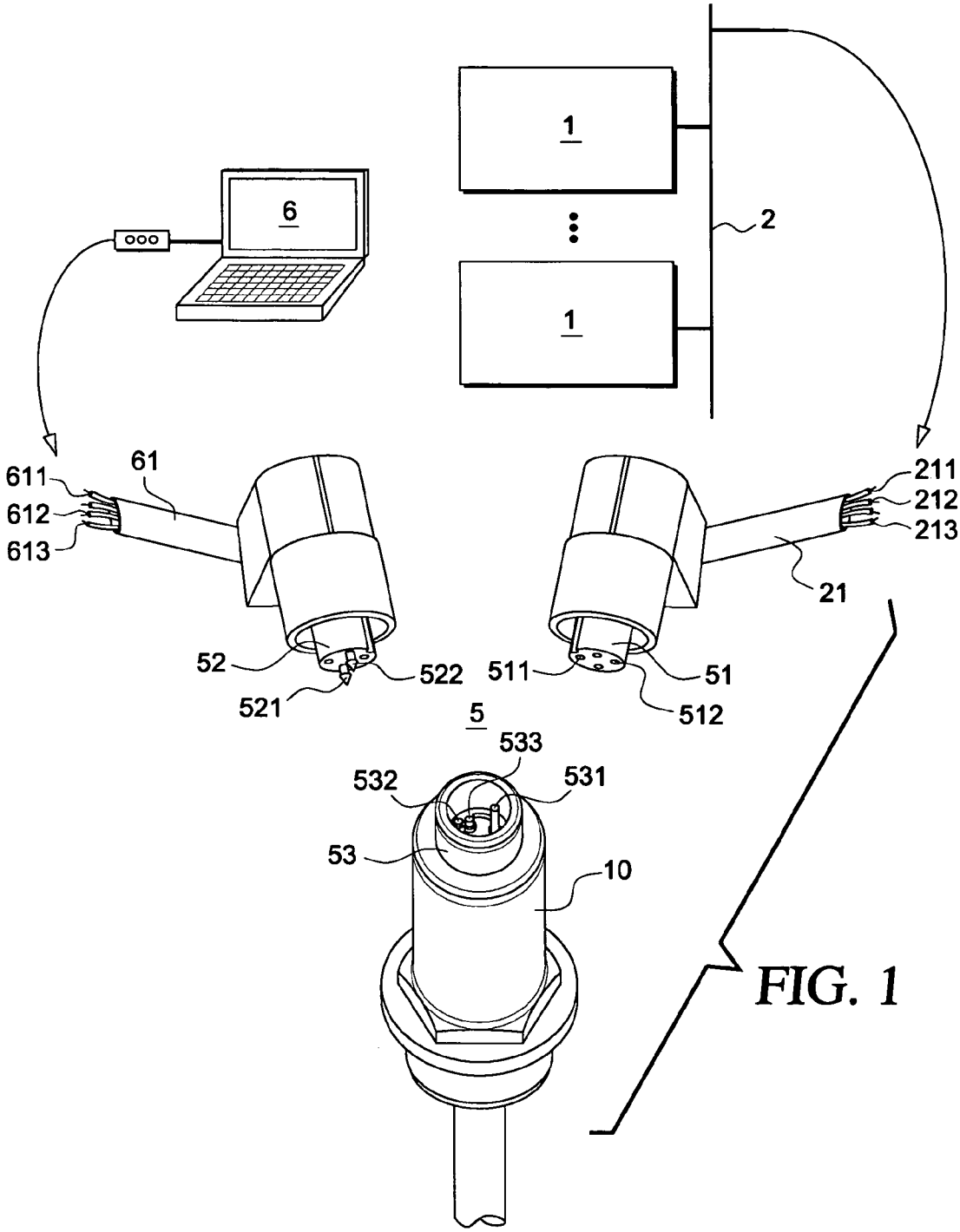
FIG. 1 shows schematically a plug coupling system for the disengageable electrical connection of a programmable field device selectively to a field bus or to a programming device.

FIG. 1 shows an embodiment of a plug coupling system 5 for the disengageable connecting of a programmable field device with a field bus 2 or with a programming device. The transmitter 1 is electrically connected with the field bus 2, at least for transmitting produced measurements to the field bus 2, by means of a bus connection cable 21 having a plurality of conductor wires, while it is electrically connected with the programming device 6, at least for receiving parametering data produced by the programming device, by means of a device connection cable 61. Both in the case of the bus connection cable 21 and in the case of the device connection cable 61, the cable can be, for example, multicore, copper wire cable applied in the usual manner.

Figure 2:
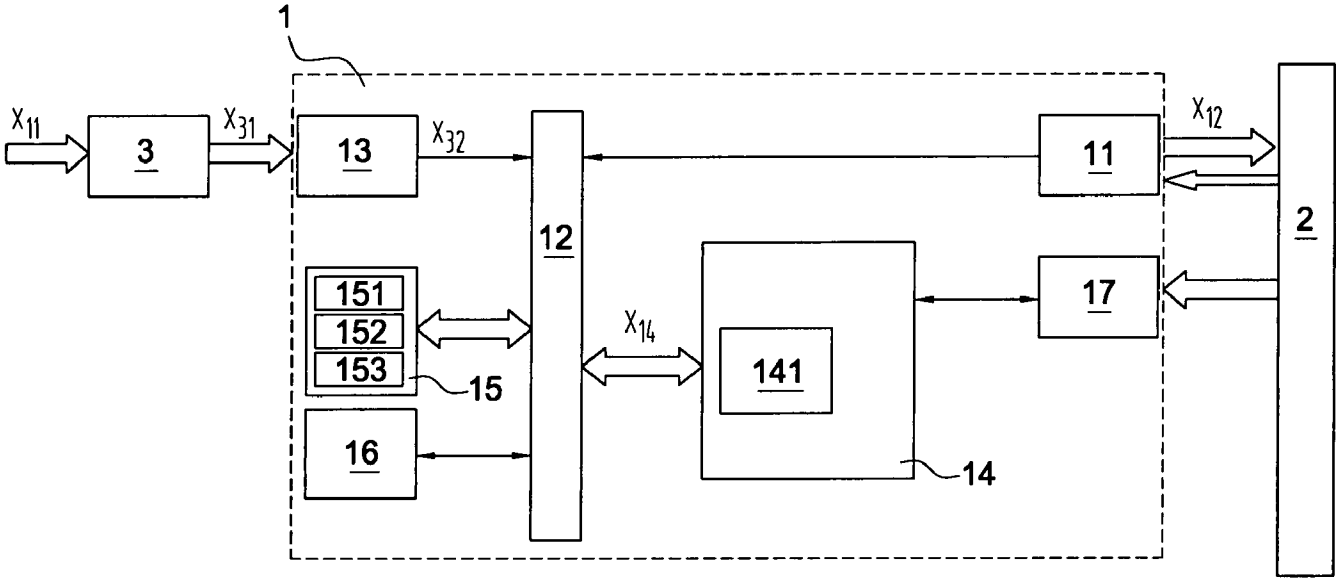
FIG. 2 shows schematically an example of an embodiment of a programmable field device having a field device electronics.

FIG. 2 shows, on the basis of a block diagram, an embodiment of a field device, here a field measuring device, that serves for producing an analog or digital measurement signal $x_{12}$ representing a process parameter $x_{11}$, e.g. a fill level in a container, a volume and/or mass flow rate of a flowing fluid, or a pressure, a pH-value and/or a temperature of a medium, etc.

For sending data, e.g. the measurement signal $x_{12}$, to other method-process observing and/or controlling information-systems, e.g. a programmable logic controller and/or a process control computer, and/or for receiving data, e.g. for receiving values of settings, the transmitter 1 includes a field device electronics, which is coupled to the external field bus 2 by means of an appropriate communications interface 11. Such bus systems, e.g. PROFIBUS-PA, FIELDBUS, CAN-BUS, etc, implement, besides the mentioned data transmission, usually also the power supply for the connected field devices. Examples of communications interface 11 are a two-conductor interface, e.g. the standard interface RS-485, a (4 mA to 20 mA)-current loop, and also a multi-conductor interface, e.g. the standard interface RS-422, TTY, etc., along with the corresponding transmission protocols. Depending on the embodiment of the communications interface 11, the field device is either directly connectable to the bus system 2 or else via a remote-I/O module.

In a preferred further development of the invention, a measuring sensor 3 is additionally connected to the transmitter, as least during operation, for reacting to the process parameter $x_{11}$. This measuring sensor serves for registering the process parameter $x_{11}$ and for converting such to a sensor signal $x_{31}$, especially an analog signal, representing such, examples being a signal current, a signal voltage or a frequency signal. Measuring sensor 3 can be e.g. a Coriolis mass flow sensor, a pressure transmitter, a pH-electrode arrangement, a temperature sensor, a fill level sensor, etc. Instead of the sensor, the field device can, however, have, for example, also an actuator controlled by the transmitter, such as e.g. an adjusting valve or an electro-motor, as well as a corresponding adjustment value source for producing a corresponding adjustment signal.

The sensor signal $x_{31}$ produced by the measuring sensor 3 is, as shown in FIG. 2, fed to the input of a converter circuit 13 of the field device electronics. The converter circuit 13 serves for converting the sensor signal $x_{31}$ into a digital sensor signal $x_{32}$. For this, the sensor signal $x_{31}$ is, for instance in manner known to those skilled in the art, anti-aliasing filtered, sampled, held and digitized by means of an appropriate A/D converter. The digital sensor signal $x_{32}$ is then conducted from the output of the converter circuit 13 via an addressable signal port to a data bus of an internal bus system 12 of the field device electronics 1. Of course, besides the measuring sensor 3 connected via converter circuit 13 to the internal bus system 12, or instead of the same, it is also possible to provide another field device, especially a measurement-data-transmitting field device, connected via an appropriate interface onto the internal bus system 12.

Besides the digitizing of the sensor signal $x_{31}$, the field device electronics serves additionally for converting the digital signal $x_{32}$ into the measurement signal $x_{12}$, as well as for generating the transmission protocols supporting the data exchange. Additionally, the field device electronics provides the control signals serving, for instance, for driving, especially for electrically or electromechanically exciting, the measuring sensor 3.

The field device electronics is preferably accommodated in a single transmitter housing 10; it can e.g. also, in the case of modularly-designed field devices, be arranged in distributed form with a measuring sensor module and a signal evaluation module.

During operational times of field devices of the described kind, one or more signal processing routines are usually invoked on the part of the user and/or on the part of the manufacturer in the field device electronics for modifying the operation of the field device. These modifications can include e.g. recalibrations of the field device electronics, improvements of implemented evaluation methods and/or modification of the transmission protocols. In modern field devices, such signal processing routines are, consequently, stored persistently, usually as software, for the kinds of modifications which are to be expected. Persistent means that the software, on the one hand, can be read and, thus, executed, especially after a re-start of the field device electronics following a loss of power, and, on the other hand, the software can also be re-programmed, especially for reconfiguring the field device electronics.

As shown in FIG. 2, the field device electronics, therefore, includes, additionally, a control circuit 14 equipped with at least one microprocessor 141, which preferably has access via the bus system 12 to the digital sensor signal $x_{32}$ as well as to software stored persistently in a non-volatile data storage circuit 15 of the field device electronics. Furthermore, also externally running processes communicating via field bus 2 with the field device electronics can access the data storage circuit 15 for the writing and/or reading of data and for interacting with the stored software.

The data storage circuit 15 can e.g. be implemented by a single EEPROM circuit and by a plurality of such circuits. Of course, other non-volatile memory circuits known to those skilled in the art can be used, such as e.g. flash EEPROM, EPROM and/or CMOS circuits, for the data storage circuit 15.

For implementing fast signal-processing routines, especially routines running in real time, the field device electronics preferably includes a volatile data storage circuit 16 of low access time to serve as working memory, into which the frequently-executed program codes of the software can be loaded e.g. from the data storage circuit 15. The data storage circuit 16 can e.g. be coupled to the control circuit 14 over the internal bus system 12 and/or be integrated directly into the control circuit 14 as cache memory. Data storage circuit 16 can be e.g. static and/or dynamic RAM circuits.

The field device electronics additionally includes an energy storage electronics 17. This serves preferably to set aside sufficient energy for at least one data-writing access to the data storage circuit 15, especially for the case of loss of the power supply implemented via the bus system 2.

The software kept in the data storage circuit 15 includes at least program code representing a current configuration of the field device electronics 1 and occupies an area 151 of memory of the data storage circuit 15. Serving as program code can be complete programs, e.g. signal processing routines producing the measurement signal $x_{12}$, separate program steps, and/or, as program parameters, coded calibration data for the field device. Additionally, the program code kept in the data storage circuit 15 can be routines serving for implementing communications interfaces and/or for driving peripheral display and operating elements. Program codes of the described type can have been generated both by the manufacturer and by the user, especially during or after start-up of the field device, and can have been implemented in the data storage circuit 15.

As shown in FIG. 1, the plug coupling system 5 includes a first coupling member 51 connected with a transmitter-side end of the bus connection cable 21. At least one first contact element 511 of the coupling member 51 is connected galvanically, especially lastingly, with a first conductor wire 211 of the bus connection cable 21, and at least one second contact element 512 of the coupling member 51 is connected galvanically, especially lastingly, with a second conductor wire 212 of the bus connection cable 21. The coupling member 51 can be, for example, a conventional coupling plug of type M 12×1 or also ⅞". The coupling member 51 can, however, also be a plug connection, such as, for example, is disclosed in DE-A 100 20 191, or, however, also a coupling plug can be used, such as described, for example, in DE-U 87 06 150 or DE-U 87 06 148.

Additionally, the plug coupling system 5 includes a second coupling member 52 connected with a transmitter-side end of the device connection cable 61. At least one first contact element 521 of the coupling member 52 is connected galvanically, especially lastingly, with a first conductor wire 611 of the bus connection cable 61, and at least one second contact element 522 of the coupling member 52 is connected galvanically, especially lastingly, with a second conductor wire 612 of the bus connection cable 61.

The plug coupling system 5 of the invention also includes on the transmitter side a third coupling member 53 with first, second and third contact elements 531, 532 and 533, with the contact elements 531, 532 and 533 being connected, especially lastingly, with the transmitter 1. The coupling member 53 can, as shown in FIG. 1, be arranged directly on the transmitter housing 10 or recessed into such.

The transmitter-side coupling member 53 is suited, according to the invention, for selective connection mechanically disengageably with the field-bus-side coupling member 51 or with the coupling member 52, and, in fact, such that each of the at least two contact elements 511, 512, respectively 521, 522, of the coupling member 51, respectively 52, contacts one of the at least three contact elements 531, 532 and 533 of the transmitter-side coupling member 53, and such that the at least two conductor wires 211, 212, respectively 611, 612 of the connection cable 21 or 61 connected at the moment are electrically connected with a respective one of the contact elements of the transmitter-side coupling member 53. Furthermore, the contact elements are so designed and so arranged in their coupling members that the third contact element 533 of the transmitter-side coupling member 53 is not galvanically connectable with any of the conductor wires 211, 212 of the bus connection cable 21, but is galvanically connectable with at least one of the conductor wires 611, 612 of the device connection cable 61.

Figure 3B:
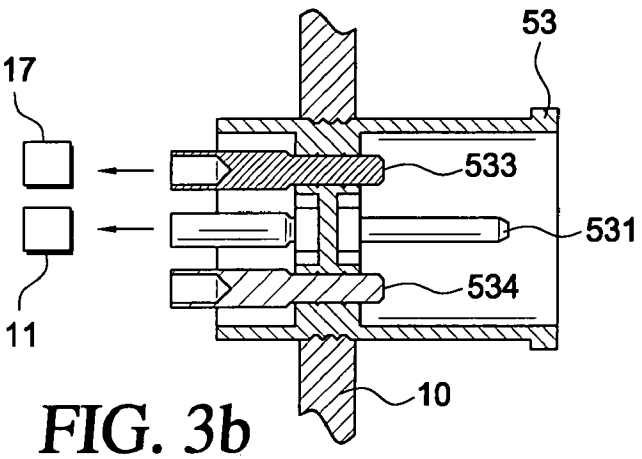
FIGS. 3*a,b* show schematically a coupling member of the plug coupling system of FIG. 1 in a sectioned first, and a second, side view.

In a preferred embodiment of the invention, the third contact element 533 of the transmitter-side coupling member 53 has for this purpose, as shown in FIG. 1 and FIG. 3*b*, a length, as measured axially in the plugging direction, which is smaller than a respective length of its first and second contact elements 531, 532.

For the case that the bus connection cable 21 is a multi-core cable and the coupling member, as already mentioned, is a correspondingly connected, multi-pole coupling plug, for example of type M 12×1 or ⅞", this feature nevertheless enables the prevention in very simple manner that voltages get fed in undesired manner over decommissioned, and thus potential-free during operation, contact elements, or decommissioned conductor wires, of the plug coupling system 5.

In a preferred further development of the invention, the field-bus-side coupling member 51 has at least one third contact element 513, especially one formed identically to its contact element 512. Contact element 513 can, if desired, be connected with a third conductor wire 213 of the bus connection cable 21.

Figure 3A:
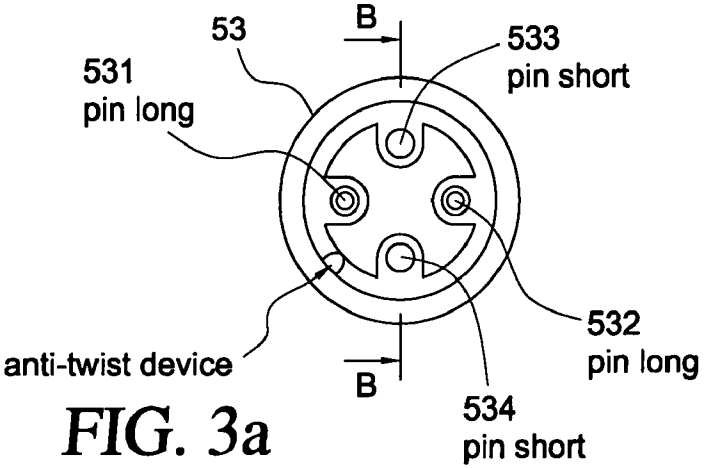

In another preferred, further development of the invention, the second coupling member 52 also has at least one third contact element 523, especially one formed identically to its contact element 522. Contact element 523 can, if desired, be connected with a third conductor wire 613 of the device connection cable 61. Furthermore, the transmitter-side coupling member 53 has, as also shown schematically in FIG. 3*a*, at least one fourth contact element 534, especially one formed identically to its contact element 533, with the contact elements of the plug coupling system 5 being so designed and so arranged in their coupling members 51, 52, 53, that also the fourth contact element 534 of the transmitter-side coupling member 53, while it is not galvanically connectable with any of the conductor wires 211, 212, 213 of the bus connection cable 21, it is galvanically connectable with at least one of the conductor wires 611, 612, 613 of the device connection cable 61.

In a further embodiment of the invention, as shown in FIG. 1, the first and second contact elements 531, 532 of the transmitter-side coupling member 53 are provided in the form of contact pins and the first and second contact elements 511, 512 of the field-bus-side coupling member 51 are provided in the form of contact sockets, with each of the two contact sockets of the field-bus-side coupling member 51 being suited for accepting one of the two contact pins of the transmitter-side coupling member 53. Additionally, at least the first contact element 521 of the coupling member 52 is, in a preferred further development of the invention, likewise provided in the form of a contact socket, which is suited for receiving one of the two contact pins of the transmitter-side coupling member 53. In a preferred embodiment of this further development of the invention, additionally at least the second contact element 522 of the coupling member 52 is likewise provided in the form of a contact pin, which is suited for contacting the third contact element 533 of the transmitter-side coupling member 53.

For improving the contact making between the second contact element 522 of the coupling member 52 and the third contact element 533 of the transmitter-side coupling member 53, at least the contact element 522 is resiliently seated, such that it is axially displaceable under the action of the contacting contact element 533, at least in the coupling direction, and, in the case of coupling members 52, 53 connected together, is held pressed against the contacting third contact element 533, at least in an end position, for example by a spring element arranged at the distal end of the second contact element 522. In the same manner, the contact element 521 of the coupling member 52 can also be resiliently seated, in order to be pressed against the contacting contact element 531.

For preventing an undesired detachment of two coupling members connected with one another, it is also possible to provide additionally on the plug coupling system 5, e.g. in manner known to those skilled in the art, a threaded connection including a union nut on the coupling members 51, 52; see, in this connection, also the already mentioned DE-A 100 20 191 or DE-U 86 13 221. Additionally, means can be provided on the plug coupling system 5 for preventing possible connecting of the wrong poles together in the plugging of two coupling members together.

The invention claimed is:

1. A plug coupling system serving for the disengageable electrical connecting of a programmable field device with a field bus or with a programming device, the field device has a measuring sensor for registering at least one process parameter ($x_{11}$) and a transmitter connected with the sensor at least during operation for producing measurements ($x_{12}$) from the registered process parameter ($x_{11}$), the transmitter is adapted to be electrically connected with the field bus by means of a bus connection cable having a plurality of conductor wires at least for sending produced measurements onto the field bus and the transmitter is adapted to be electrically connected with the programming device by means of a device connection cable at least for receiving parametering data produced by the programming device, the coupling system comprising:

a first coupling member connected with a transmitter-side end of the bus connection cable, said first coupling member has at least: a first contact element, which is galvanically, especially lastingly, connected with a first conductor wire of the bus connection cable, and a second contact element, which is galvanically, especially lastingly, connected with a second conductor wire of the bus connection cable;

a second coupling member connected with a transmitter-side end of the device connection cable, said second coupling member has at least: a first contact element, which is galvanically, especially lastingly, connected with a first conductor wire of the device connection cable, and a second contact element, which is galvanically, especially lastingly, connected with a second conductor wire of the device connection cable; and a third coupling member, arranged on the transmitter side, having at least a first, a second and a third contact element, which contact elements are connected, especially lastingly, with the transmitter, wherein:

said third coupling member is suited for selective, mechanically disengageable connection with said first coupling member or with said second coupling member such that at least two contact elements of said first coupling member or said second coupling member, as the case may be, always contacts a respective one of the at least three contact elements of said third coupling member, and the at least two conductor wires of the connection cable connected at the moment are each electrically connected with a respective contact element of said third coupling member; and the contact elements are so designed and so arranged in their associated coupling members, that the third contact element of said third coupling member, while not galvanically connectable with any of the conductor wires of the bus connection cable, is galvanically connectable with at least one of the conductor wires of the device connection cable.

2. The plug coupling system as claimed in claim 1, wherein:

the first contact element and the second contact element of said third coupling member are provided in the form of contact pins, and the first contact element and the second contact element of said first coupling member are provided in the form of contact sockets, with each of the two contact sockets of said first coupling member being suited to receive a respective one of the two contact pins of said third coupling member.

3. The plug coupling system as claimed in claim 1, wherein:

at least the first contact element of said second coupling member is likewise provided in the form of a contact socket, which is suited for receiving one of the two contact pins of said third coupling member.

4. The plug coupling system as claimed in claim 1, wherein:

the third contact element of said third coupling member has a length in the coupling direction, which is smaller than a respective length of its first and second contact elements.

5. The plug coupling system as claimed in claim 1, wherein:

at least the second contact element of said second coupling member is likewise provided in the form of a contact pin, which is suited for contacting the third contact element of said third coupling member.

6. The plug coupling system as claimed in claim 1, wherein:

at least the second contact element of said second coupling member is resiliently seated such that it is displaceable at least in the coupling direction when acted upon by the contacting, third contact element of said third coupling member and, in the case of connected second and third coupling members is, at least in an end position, held pressed against the contacting, third contact element.

7. The plug coupling system as claimed in claim 1, wherein:

said first coupling member has at least one, third contact element, especially one formed identically to its second contact element.

8. The plug coupling system as claimed in claim 1, wherein;

the bus connection cable has a third conductor wire, especially a decommissioned third conductor wire, galvanically connected with the contact element of said first coupling member.

9. The plug coupling system as claimed in claim 1, wherein:

said second coupling member has at least one, third contact element, especially a third contact element which is constructed identically to its second contact element.

10. The plug coupling system as claimed in claim 1, wherein:

the device connection cable has a third conductor wire galvanically connected with the contact element of said second coupling member.

11. The plug coupling system as claimed in claim 1, wherein:

said third coupling member has at least one, fourth contact element, especially a fourth contact element constructed identically to its third contact element.

12. The plug coupling system as claimed in claim 1, wherein: the contact elements are so designed and so arranged in their associated coupling members, that also the fourth contact element of said third coupling member, while not being galvanically connectable with any of the conductor wires of the bus connection cable, is, however, galvanically connectable with at least one of the conductor wires of the device connection cable.

* * * * *